US005186085A

United States Patent [19]

Monacelli

[11] Patent Number: 5,186,085

[45] Date of Patent: Feb. 16, 1993

[54] SCREW DRIVING DEVICE FOR SCREWS CONNECTED BY A SCREW CONNECTING STRIP

[76] Inventor: Umberto Monacelli, Via Parini 6, Monza, (Milan), Italy

[21] Appl. No.: 769,267

[22] Filed: Oct. 1, 1991

[30] Foreign Application Priority Data

Oct. 2, 1990 [IT] Italy ..... 21622 A/90

[51] Int. Cl.[5] ..... B25B 23/06

[52] U.S. Cl. ..... 81/434; 81/435; 227/120; 227/123

[58] Field of Search ..... 81/57, 37, 434, 435; 227/120, 123

[56] References Cited

U.S. PATENT DOCUMENTS 4,367,837 1/1983 Manino ..... 81/434 X 4,674,367 6/1987 Aab et al. ..... 81/434 X

FOREIGN PATENT DOCUMENTS 2641828 9/1976 Fed. Rep. of Germany .

3542702 3/1985 Fed. Rep. of Germany .

OTHER PUBLICATIONS

EP Search Report of EP 91 205241.8 dated Apr. 12, 1991.

*Primary Examiner*—James G. Smith

*Attorney, Agent, or Firm*—Diller, Ramik & Wight

[57] ABSTRACT

A screw driving device for screws connected by a screw connecting strip is essentially constituted by a motor body and a guide with which a screw magazine and a slider are associated, with said slider being provided with side channels for screw feeding and a longitudinal channel for screwing down said screws; on said slider, an element is furthermore provided which, during the screwing down step, prevents said screw connecting strip and the other screws from moving from their correct feeding position.

11 Claims, 4 Drawing Sheets

Fig.4
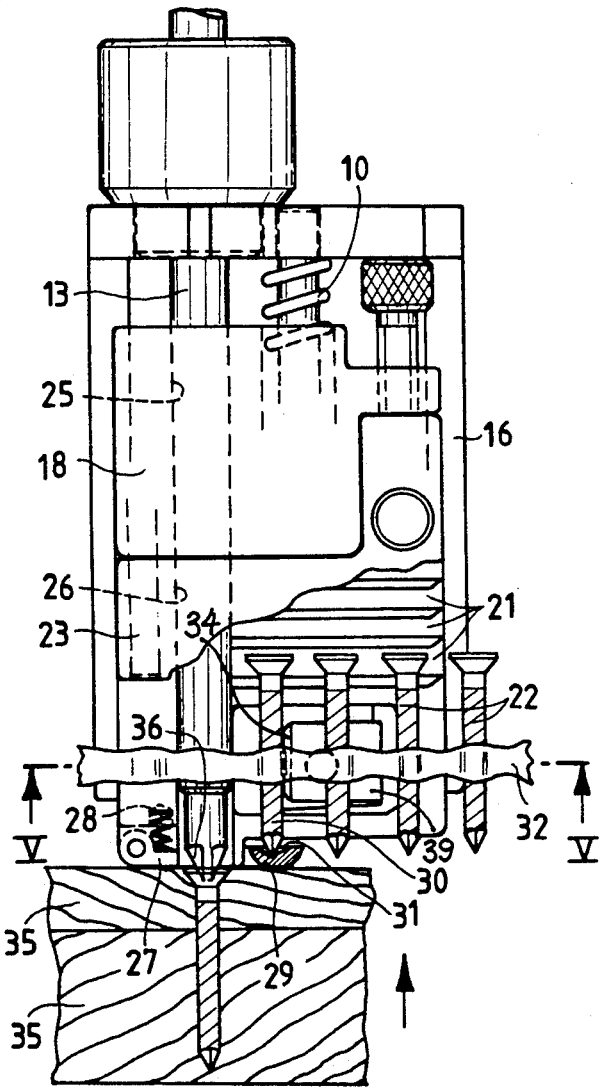
Fig.5
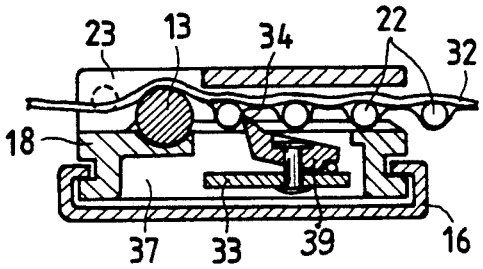
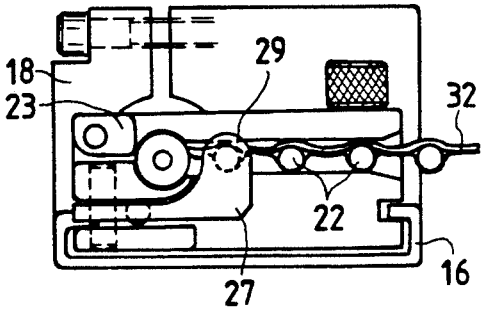
Fig.6

SCREW DRIVING DEVICE FOR SCREWS CONNECTED BY A SCREW CONNECTING STRIP

The instant invention relates to a screw driving device for screws connected by a screw connecting strip.

Several types of screw driving devices are known, which differ from one another mainly as regards the screw guide system and the devices which keep the screws in their correct position during the screwing-down and dragging operations.

The screw driving devices known from the prior art, besides having poor flexibility in accepting screws of different lengths, can often undergo jamming problems, and this limits their use.

A purpose according to the present invention is that of providing a screw driving device for screwing down screws connected by a screw connecting strip, in which an element actuated at each screwing down step keeps the screws blocked, in the vicinity of the screwing down spindle, in their correct feeding position, so that the only moving screw is the one which is being screwed down.

Another purpose according to the present invention is that of allowing the longitudinal movement of only the slider inside its guide, with nonessential movements of the screws, different from the transversal movements of said screws from the screw magazine to the slider, being avoided.

In order to achieve such purposes, a screw driving device for screws connected by a screw connecting strip was developed, which is essentially constituted by a motor body with a spindle and associated with a screw magazine, on said motor a support being mounted inside which said spindle enters, said support bearing a guide suitable for slidingly housing a slider, with said support and said slider constituting a fixed element relatively to said motor body, said slider being in engagement with elastic means and counter-urging means, which screw driving device is characterized in that said slider, provided with means for causing screws connected by a screw connecting strip to advance, is provided with a plurality of mutually parallel transversal channels capable of receiving screws of different lengths, in such a way that the tip of said screws is always at the same distance from the front side of the screw driving device, with said transversal channels a longitudinal channel being associated in correspondence of said spindle, in front of said slider an "L"-shaped element being provided, which is directed upwards and is hinged in an elastically swinging way onto an end of said slider, so that a portion of said "L"-shaped element can come into engagement with a screw adjacent to said longitudinal channel in correspondence of said spindle.

That portion of said "L"-shaped element which comes into engagement with the screw adjacent to said longitudinal channel is provided with a recess suitable for receiving the tip of said screw. In particular, in the vicinity of the hinge, the "L"-shaped element is in engagement with a spring.

Above said transversal channels a longitudinally adjustable, rotatable cover is provided, which is equipped with further transversal channels opposite to said transversal channels provided on said slider.

The technical features and further advantages of the present invention will be clearer from the following disclosure, which is supplied for illustrative, non-limitative purposes, made by referring to the accompanying drawings, in which:

FIG. 4 shows a top plan view of the screw driving device of FIG. 1 in a different operating position thereof;

FIG. 5 shows a sectional view according to the section plane identified by line V-V of FIG. 4;

FIG. 6 shows an elevation front view of the screw driving device of FIG. 1.

Figure 1:
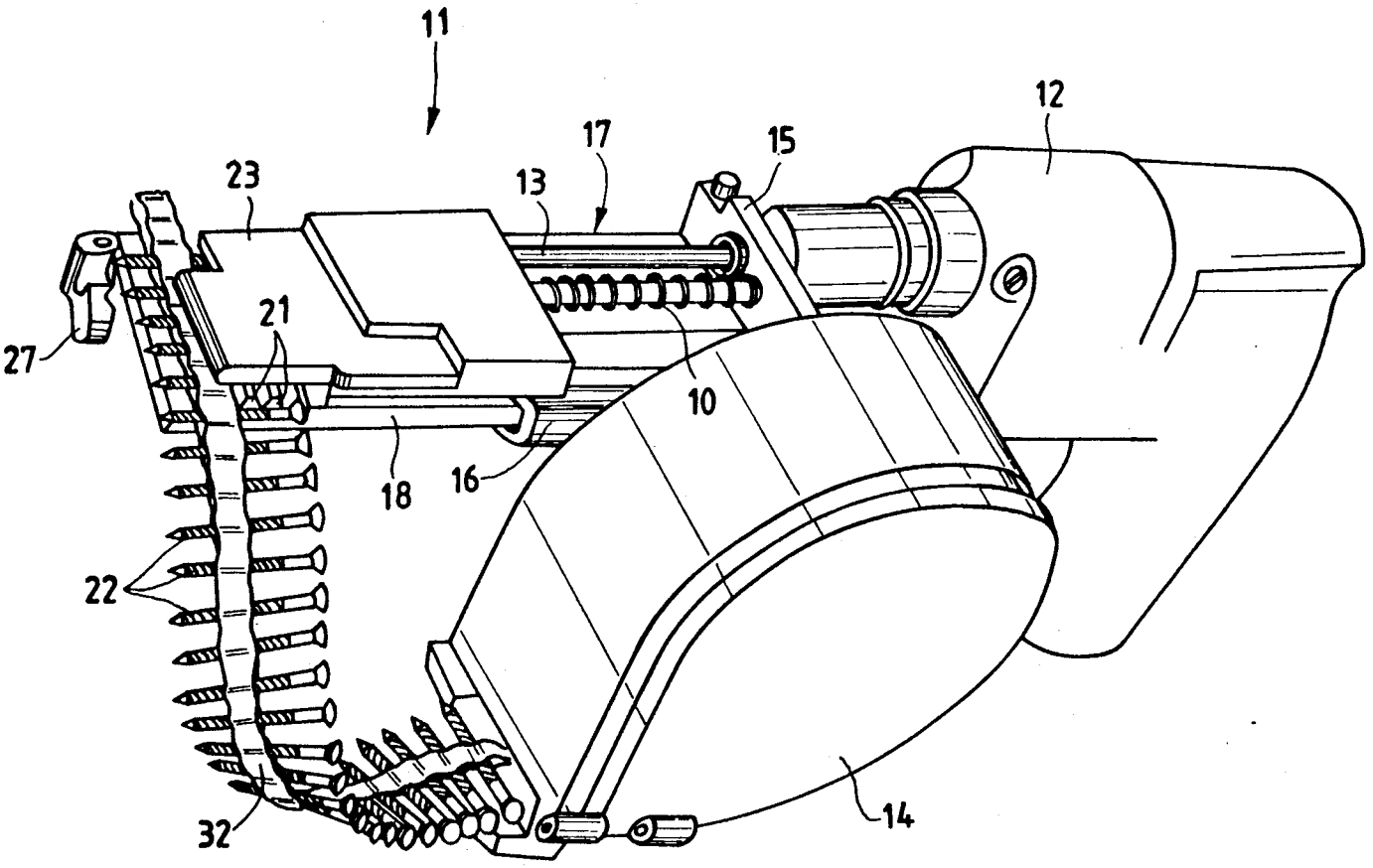
FIG. 1 shows a perspective assembly view of a screw driving device according to the present invention.

Referring to the figures, the reference numeral 11 identifies a screw driving device according to the present invention which is essentially constituted by a motor body 12 provided with a spindle 13, with which a side screw magazine 14 and a front support 15 are associated; said front support 15 is provided with a guide 16 extending in front of said motor body.

The spindle 13 enters the support 15 in correspondence of a side portion 17 of the guide 16.

The guide 16 supports a slider 18 in engagement with a spring 10 surrounding a pin (unnumbered), with the latter elements, by being interposed between the support 15 and the slider 18, acting as counter-urging and guide elements to bring the slider 18 always back to its initial position. A screw advancing mechanism for causing the screws housed inside the screw magazine 14 to advance, is generally indicated with 20.

The slider 18 is provided with a plurality of mutually parallel transversal channels 21 inside which are screws 22 of different sizes, connected by a screw connecting strip 32 of plastic material. Above the transversal channels 21 is a rotatable cover 23, adjustable in the longitudinal direction. The rotatable cover 23 is provided with further transversal channels 24 opposite to the transversal channels 21 provided on the slider 18.

The slider 18 in provided with a side bore 25 inside which the spindle 13 enters. Said side bore 25 is in communication with a longitudinal channel 26.

Figure 2:
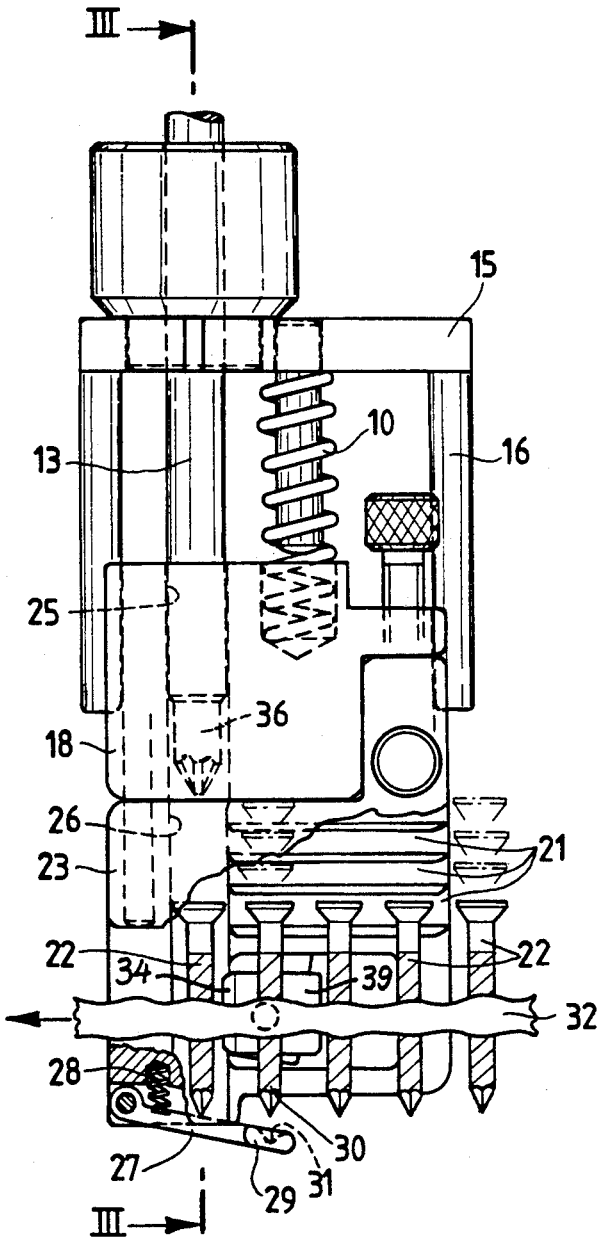
FIG. 2 shows a top plan view of the screw driving device of FIG. 1 in a first operating position thereof.
Figure 3:
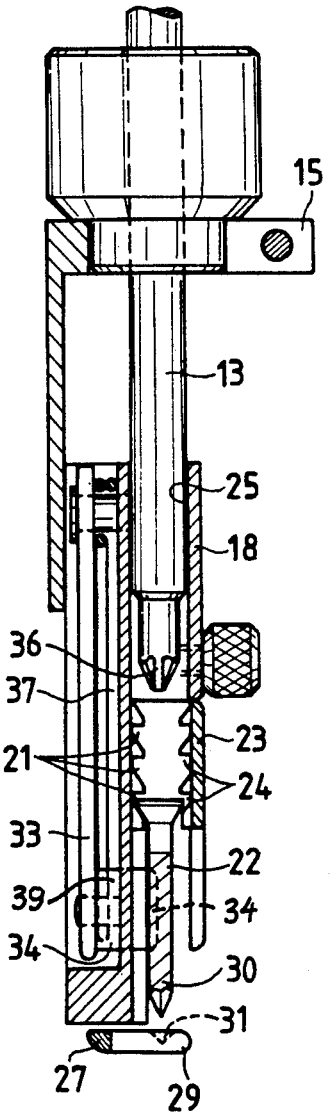
FIG. 3 shows a sectional view according to the section plane identified by line III-III of FIG. 2.

In front of the slider 18 and at a side end, adjacent to said longitudinal channel 26, thereof, there is an "L"-shaped element indicated by the reference numeral 27, elastically hinged in engagement with a spring 28 and positioned in such a way that a portion 29 thereof can move into engagement with a screw adjacent to the longitudinal channel as indicated by the reference numeral 30 in FIGS. 2–4.

The portion 29 of the element 27 is provided with a recess 31 inside which a tip (unnumbered) of the screw 30 can be received.

The screw advancing mechanism, generally indicated with the reference numeral 20 (FIG. 7), can be actuated by means of a wheel 19 during the backward stroke of the slider 18, and is equipped, at an end thereof, with a plate 33 carrying a block 39 provided with an upwardly directed tongue 34.

The plate 33 is housed and slides inside a hollow 37 provided in the slider 18, and is elastically mounted on the screw advancing mechanism 20.

Figure 7:
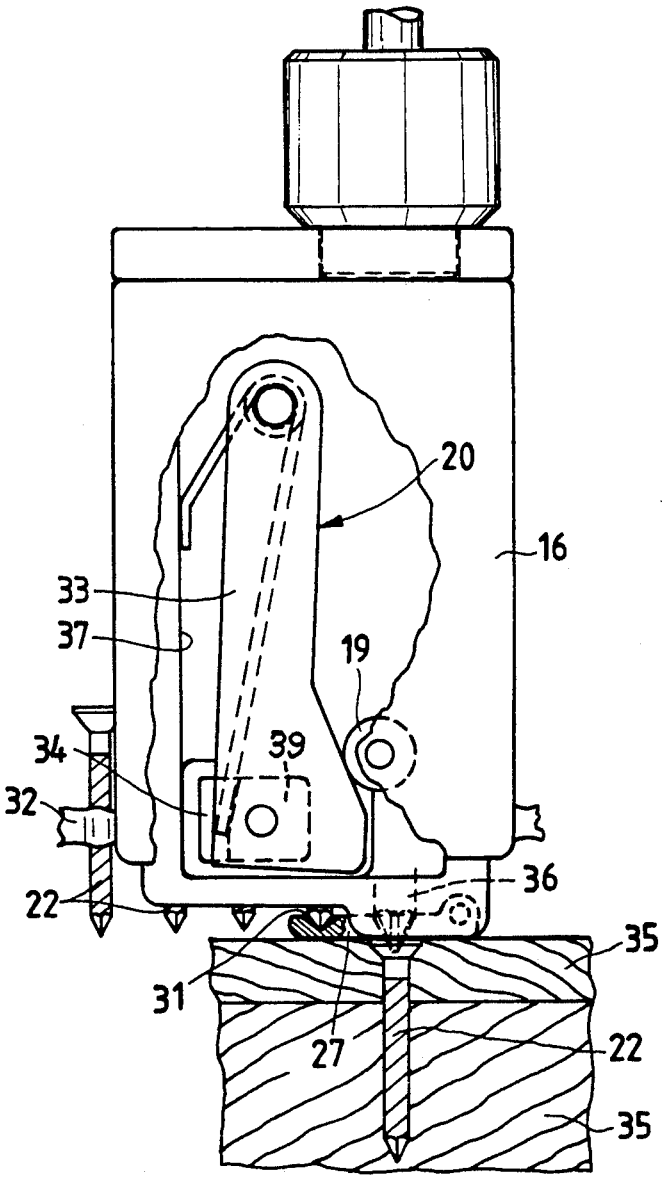
FIG. 7 shows a bottom plan view of the screw driving device of FIG. 1 in an operating position thereof.

In FIGS. 4 and 7, the screw driving device 11 according to the present invention is depicted in the position thereof in which the slider 18 has completed its backward stroke, making it possible for a screw 22 to be screwed down into two elements generally indicated by the reference numeral 35. In this position the "L"-shaped element 27 blocks the tip of the screw 30 inside the recess 31.

FIG. 1 shows a screw driving device 11 according to the present invention in its resting position, in which the strip 32 of plastic material, coming from the screw magazine 14, which connects the screws 22, is inserted in the slider 18. At this point, the screws are ready to be screwed down under the action of the spindle 13 equipped with a screwdriver tip 36.

When the screw driving device 11 is brought into contact with the parts 35 into which screws have to be installed, and the motor body 12 is pushed forward, the slider 18 moves backwards along the guide 16 and the spindle 13, driven to revolve by the motor means, comes into contact with the screw 22 which is housed inside the longitudinal channel 26. Additionally, the "L"-shaped element 27 is pushed towards the slider 18, so that the recess 31 provided at an end thereof comes into engagement with, and blocks, the tip of the screw 30 adjacent to the longitudinal channel 26, preventing said screw 30 from tilting during the screwing down operation, consequently preventing the adjacent screws from undergoing any other movements and securing a correct feed of said screws from the screw magazine 14 to the slider 18, with no jamming.

When the slider 18, which contains the screw advancing mechanism 20 actuated by the wheel 19, - - has reached its stroke end, the slider 18 is urged forwards by the spring 10.

As a consequence thereof, the plate 33, which slides inside the hollow 37, is pushed by the screw advancing means towards the screw magazine 14, so that during the return stroke, the tongue 34 gets into engagement with another screw to bring it into the longitudinal channel 26. The plate, which occupies most volume of said hollow 37, makes with the screw a rather extended contact, which may be defined as a surficial contact, and owing to this reason further improves the reliability of screw advancement and feed.

It should be also observed that as a consequence of the configuration of the screw driving device according to the present invention, the tip of the screws is always positioned at a same distance from the front side of the slider.

I claim:

1. A screw driving device for screws connected together by a screw connecting strip, means for rotating a screw driving head about an axis thereof, screw advancing means for advancing said screw connecting strip to bring successive screws thereof into generally axial alignment with said screw driving head axis, a plurality of generally parallel screw head receiving channels disposed generally normal to said screw driving head axis for guiding screws of different lengths by their heads to said screw driving head axis, and said screw head receiving channels being spaced from each other along said screw driving head axis whereby the tips of said screws will always be located at the same relative position irrespective of screw length due to the selected disposition of the screw heads of different length screws in different ones of said screw head receiving channels.

2. A screw driving device for screws connected by a screw connecting strip, comprising a motor body having a screw driving spindle and associated with a screw magazine, a support mounted on said motor body with said spindle entering inside said support, a guide fixed to said support and a slider having a front side and a rear side slidingly housed in said guide, elastic means and counter-urging means in engagement with the rear side of said slider to keep the slider in a forward resting position with respect to said support, a longitudinal channel provided in said slider for slidingly housing said spindle and a screw to be driven, a screw advancing mechanism associated with said slider, and a plurality of mutually parallel transversal channels provided in the slider for receiving screws of different lengths such that the tip of said screw is always at the same distance from the front side of the slider.

3. Screw driving device according to claim 2 including an "L"-shaped element in front of said slider and said "L"-shaped element being directed toward and being elastically hinged to an end of said slider whereby a portion of said "L"-shaped element can engage a screw adjacent to said longitudinal channel in correspondence of said spindle.

4. Screw driving device according to claim 3 characterized in that the "L"-shaped element which engages said screw adjacent to the longitudinal channel is provided with a recess suitable for receiving the tip of said screw.

5. Screw driving device according to claim 3 characterized in that said "L"-shaped element is in engagement with a spring urging said "L"-shaped element away from said adjacent screw.

6. Screw driving device according to claim 3 wherein a longitudinally adjustable and rotatable cover is provided above said transversal channels, and said longitudinally adjustable and rotatable cover is equipped with further transversal channels opposite to said slider/-transversal channels.

7. Screw driving device according to claim 3 characterized in that said slider is provided with a hollow, said screw advancing mechanism includes a plate movable inside said hollow, said plate being equipped with an upwardly directed tongue, and said plate being elastically linked to a portion of said screw advancing mechanism.

8. Screw driving device according to claim 3 characterized in that said slider is adapted to receive screws of different links.

9. Screw driving device according to claim 2 wherein a longitudinally adjustable and rotatable cover is provided above said transversal channels, and said longitudinally adjustable and rotatable cover is equipped with further transversal channels opposite to said slider/-transversal channels.

10. A screw driving device according to claim 3 wherein said slider has a hollow, said screw advancing mechanism includes a plate hinged at one of its ends to said slider inside said hollow, a block movably attached to another end of said plate, said block having an upwardly directed tongue, elastic means for urging said plate and said block toward said longitudinal channel in said slider, and counteracting fixed means for urging said plate and said block away from said longitudinal channel during movement of the slider away from its resting position, thereby bringing the tongue of said block into engagement with another screw to be transferred into said longitudinal channel during the return movement of the slider in its resting position.

11. A screw driving device according to claim 2 wherein said slider has a hollow, said screw advancing mechanism includes a plate hinged at one of its ends to said slider inside said hollow, a block movably attached to another end of said plate, said block having an upwardly directed tongue, elastic means for urging said plate and said block toward said longitudinal channel in said slider, and counteracting fixed means for urging said plate and said block away from said longitudinal channel during movement of the slider away from its resting position, thereby bringing the tongue of said block into engagement with another screw to be transferred into said longitudinal channel during the return movement of the slider in its resting position.

* * * * *